US007703369B1

(12) United States Patent
Lee

(10) Patent No.: US 7,703,369 B1
(45) Date of Patent: Apr. 27, 2010

(54) COMBINATION BULLET SEATING AND FACTORY CRIMP DIE

(75) Inventor: Richard J. Lee, Hartford, WI (US)

(73) Assignee: Lee Precision, Inc., Hartford, WI (US)

( * ) Notice: Subject to any disclaimer, the term of this patent is extended or adjusted under 35 U.S.C. 154(b) by 0 days.

(21) Appl. No.: 12/366,120

(22) Filed: Feb. 5, 2009

(51) Int. Cl.
*F42B 33/00* (2006.01)

(52) U.S. Cl. ..... 86/43

(58) Field of Classification Search ..... 86/18, 86/23, 25, 29, 30, 36, 39, 41, 43, 1.1
See application file for complete search history.

(56) References Cited

U.S. PATENT DOCUMENTS 2,700,915 A * 2/1955 Pattison ..... 86/43
3,440,923 A * 4/1969 Purdie ..... 86/43
4,385,546 A 5/1983 Lee
4,862,567 A * 9/1989 Beebe ..... 86/43
4,869,148 A * 9/1989 Tucker ..... 86/43
5,079,986 A 1/1992 Lee
6,244,154 B1 * 6/2001 Beebe et al. ..... 86/43

* cited by examiner

*Primary Examiner*—Michael Carone
*Assistant Examiner*—Jonathan C Weber
(74) *Attorney, Agent, or Firm*—Donald J. Ersler

(57) ABSTRACT

A combination bullet seating and factory crimp die includes a collet closing die, a crimping collet, a die cap, a seating lock, a bullet depth adjustment screw and a trigger. The crimping collet is inserted into the collet closing die. The trigger is placed in the collet closing die. The bullet depth adjustment screw is threaded into the seating lock. The seating lock is inserted into the die cap. The seating lock includes a sear groove for receiving a C-ring sear. The collet closing die is threaded into the die cap. A bullet seater is retained in the seating lock. In use, a bullet on a mouth of a cartridge case is pushed into the crimping collet. The bullet seater seats the bullet. The trigger pushes the C-ring sear into the sear groove, which allows the mouth of the cartridge to be crimped without moving the bullet.

15 Claims, 5 Drawing Sheets

COMBINATION BULLET SEATING AND FACTORY CRIMP DIE

BACKGROUND OF THE INVENTION

1. Field of the Invention

The present invention relates generally to loading or reloading ammunition cartridge cases and more specifically to a combination bullet seating and factory crimp die that crimps the cartridge case after the bullet has been seated without further motion of the bullet relative to the cartridge case.

2. Discussion of the Prior Art

When reloading ammunition, it has become common to use a bullet-seating die that also crimps the bullet in place. A tapered cone within the die forms the crimp. Because a bullet-seating plug and crimping shoulder move as one, the seating plug continues to push the bullet deeper into the case while applying the crimp. Further bullet seating is acceptable, if the bullet has a crimping groove or the bullet is fabricated from soft lead. Adjusting for a firm crimp, while positioning the bullet to the correct depth is difficult for the novice reloader. It is also difficult to form a tight crimp if the bullet has a copper jacket and does not have a crimp groove to accept the crimp. Bullet seating that occurs during crimping is evident in reloading dies from all manufacturers for over 60 years.

U.S. Pat. No. 5,079,986 to Lee discloses a die for crimping bullets in ammunition cases. The Lee '986 patent crimps the bullet in a separate die after being seated with a standard seating die. A collet applies the crimp. A conical surface within the die wedges the collet to crimp a mouth of a cartridge case inward into the crimp groove of the bullet. The crimping process requires that the collet and bullet move together. The collet and cartridge are moved in unison by the shell holder. The finished crimp closely resembles the crimp applied to factory made ammunition. The Lee invention will form a perfect crimp even if the bullets have no cannular. The Lee crimp die has been well received by the consumer because of the improved accuracy and serviceability of ammunition. Unfortunately, the Lee crimp die requires an extra die and operation in the reloading process.

Combining the bullet seating operation with the collet type crimp is difficult, because bullet seating requires the seating die to be moved in relationship to the cartridge case, while the collet crimp is formed without relative movement between cartridge case and collet. Upward movement of the cartridge case, while being squeezed by the collet would cause the case to bulge below the crimp. U.S. Pat. No. 4,385,546 to Lee discloses cartridge reloading dies. The Lee '546 patent includes an ammunition casing reloading die set. An adjustment screw is adjusted such that, substantially coincident with the seater screw element coming to a stop, the edge of the casing mouth encounters a small conical shoulder that crimps the casing to the bullet.

Accordingly, there is a clearly felt need in the art for a combination bullet seating and factory crimp die, which crimps the cartridge case after the bullet has been seated to a desired depth without the bullet being forced deeper as with currently available reloading dies.

SUMMARY OF THE INVENTION

The present invention provides a combination bullet seating and factory crimp die that crimps the cartridge case after the bullet has been seated without relative motion between cartridge case and bullet. The combination bullet seating and factory crimp die (combination crimp die) includes a collet closing die, a crimping collet, a die cap, a seating lock, a bullet depth adjustment screw, a trigger and a C-ring sear.

The collet closing die includes a collet counterbore formed in one end thereof. A trigger countersink is formed in the other end thereof to retain the trigger. A collet retaining rib is formed between the collet bore and the trigger countersink. The crimping collet includes a cartridge case counterbore formed in one end and an inner crimp bore formed at the other end of the crimping collet. A rib retaining groove is formed in an outer diameter of the crimping collet at substantially the other end to receive the collet retaining rib. A collet closing cone is formed on an inner perimeter of the collet closing die between the trigger countersink and the collet retaining rib. The collet closing cone is sized to receive a collet cone formed on the other end of the crimping collet.

The die cap includes a lock counterbore and an inner thread is formed at an entrance of the lock counterbore. The seating lock includes a spring flange formed on one end. The seating lock is inserted into a compression spring and the compression spring is axially is supported by the spring flange. A sear groove is formed in a perimeter of the spring flange to receive a C-ring sear. A seating counterbore is formed in one end of the seating lock and an adjustment thread is formed through the other end of the seating lock to threadably receive the bullet depth adjustment screw. The bullet depth adjustment screw is threaded into the adjustment thread and then a floating bullet seater is inserted into the seating counterbore.

In use, a bullet on a mouth of a cartridge case is pushed into the crimping collet with a shell holder retained in an end of a ram of a reloading press. As the bullet and cartridge case are pushed into crimping collet, an end of the bullet pushes one end of the floating bullet seater, until the other end of the floating bullet seater is stopped by an end of the bullet depth adjustment screw. The floating bullet seater seats the bullet in the cartridge case to a desired depth. As the mouth of the cartridge case is pushed into the inner crimp bore, a top of the trigger is pushed into the C-ring sear. The trigger contacts the C-ring sear and pushes the C-ring sear into the sear groove, which allows the mouth of the cartridge to be crimped without the bullet moving relative to the mouth during crimping.

Accordingly, it is an object of the present invention to provide a combination crimp die, which crimps the cartridge case after the bullet has been seated to a desired depth without relative motion between the bullet and the cartridge case.

These and additional objects, advantages, features and benefits of the present invention will become apparent from the following specification.

DETAILED DESCRIPTION OF THE PREFERRED EMBODIMENTS

Figure 1:
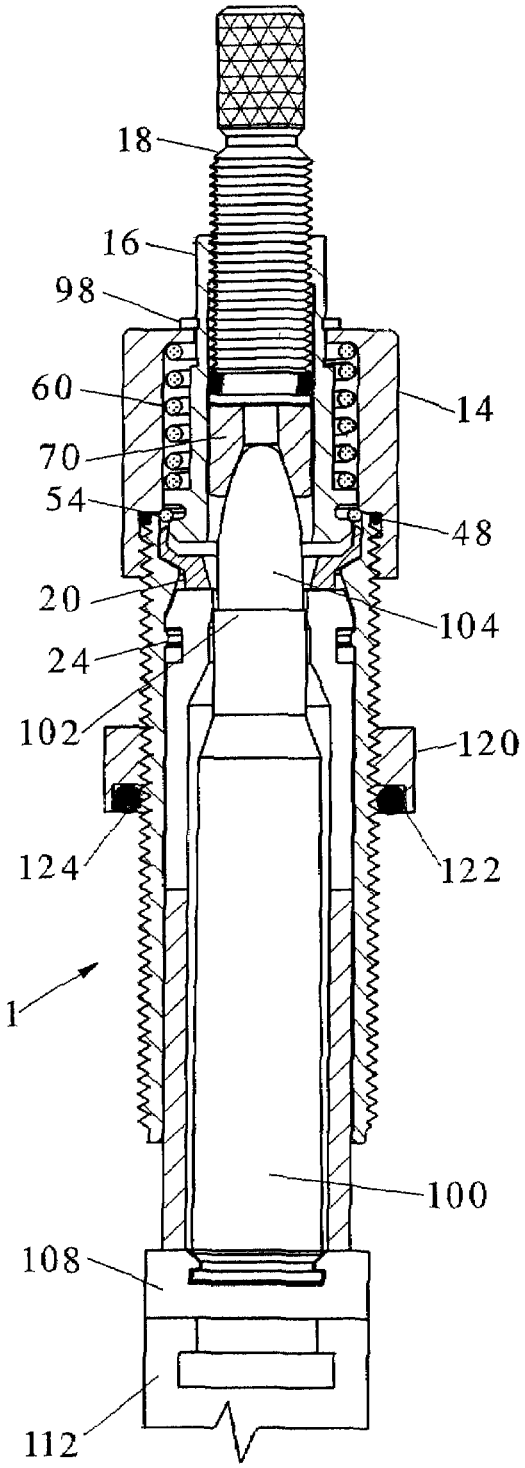
FIG. 1 is a cross sectional view of a combination crimp die with a bullet and a cartridge case inserted therein in accordance with the present invention.
Figure 2:
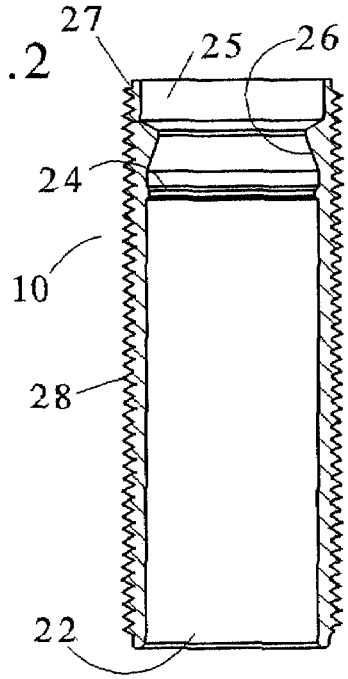
FIG. 2 is a cross sectional view of a collet closing die of a combination crimp die in accordance with the present invention.
Figure 3:
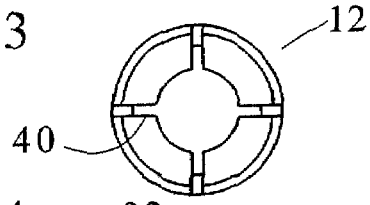
FIG. 3 is a top view of a crimping collet of a combination crimp die in accordance with the present invention.
Figure 4:
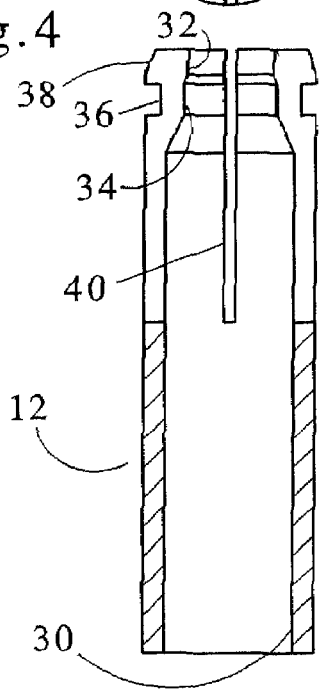
FIG. 4 is a cross sectional view of a crimping collet of a combination crimp die in accordance with the present invention.

With reference now to the drawings, and particularly to FIG. 1, there is shown a cross sectional view of a combination crimp die 1. With reference to FIGS. 1-4, the combination crimp die 1 includes a collet closing die 10, a crimping collet 12, a die cap 14, a seating lock 16, a bullet depth adjustment screw 18, a trigger 20 and a C-ring sear 54. The collet closing die 10 includes a collet counterbore 22 formed in one end. A collet retaining rib 24 is formed on an inside of said collet bore 22 at substantially the other end thereof. A trigger countersink 25 is formed in the other end of the collet closing die 10 to receive the trigger 20. A collet closing cone 26 is formed between the collet retaining rib 24 and the trigger countersink 25. A collet o-ring groove 27 is formed in the other end of the collet closing die 10. A male thread 28 is formed on an outer perimeter of the collet closing die 10.

The crimping collet 12 includes a cartridge case counterbore 30 is formed in one end and an inner crimp bore 32 formed at the other end of thereof. A crimp lead-in bore 34 is formed before the inner crimp bore 32 to align a mouth 102 of a cartridge case 100. A rib retaining groove 36 is formed in an outer diameter of the crimping collet 12 at substantially the other end to receive the collet retaining rib 24. An axial travel of the crimping collet 12 in the collet closing die 10 is limited by the movement of the collet retaining rib 24 in the rib retaining groove 36. The collet closing cone 26 is sized to receive a collet cone 38 formed on the other end of the crimping collet 12. A plurality of closing slots 40 are cut in substantially the other end of the crimping collet 12.

Figure 5:
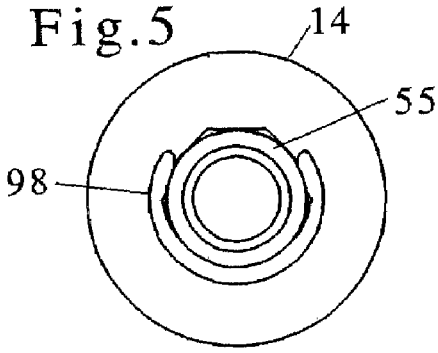
FIG. 5 is a top view of a combination crimp die in accordance with the present invention.
Figure 6:
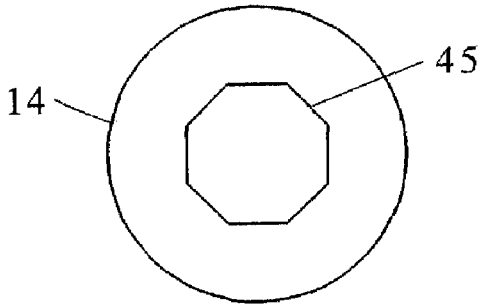
FIG. 6 is a top view of a die cap of a combination crimp die in accordance with the present invention.
Figure 8:
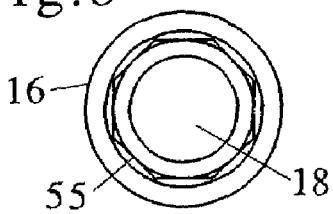
FIG. 8 is a top view of a seating lock with a bullet depth adjustment screw threaded into the seating lock of a combination crimp die in accordance with the present invention.
Figure 7:
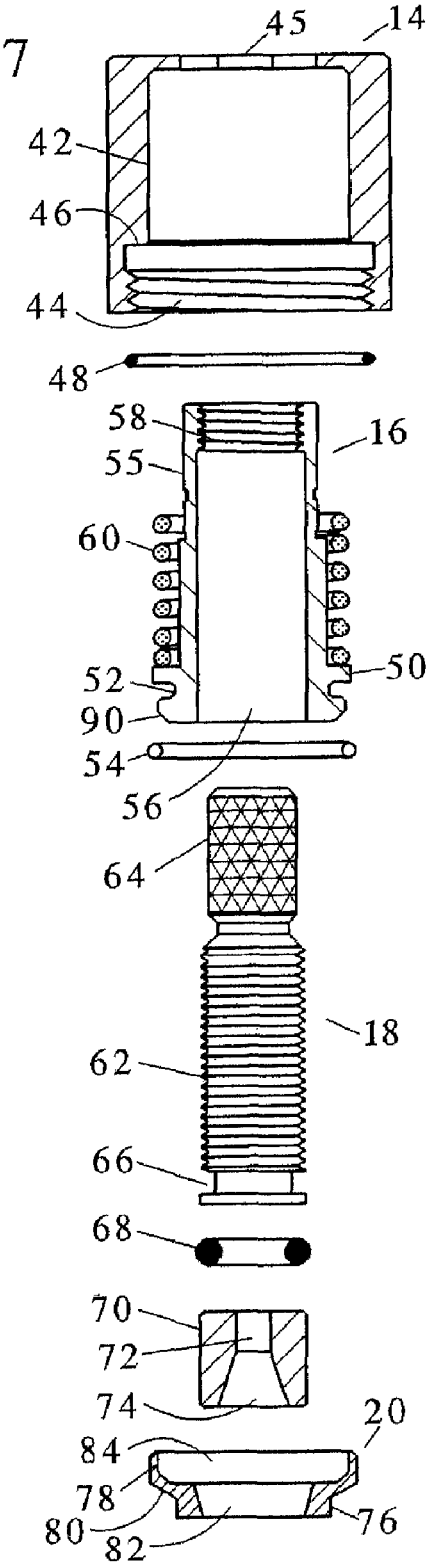
FIG. 7 is an exploded cross sectional view of a combination crimp die without a collet closing die and a crimp collet in accordance with the present invention.
Figure 9:
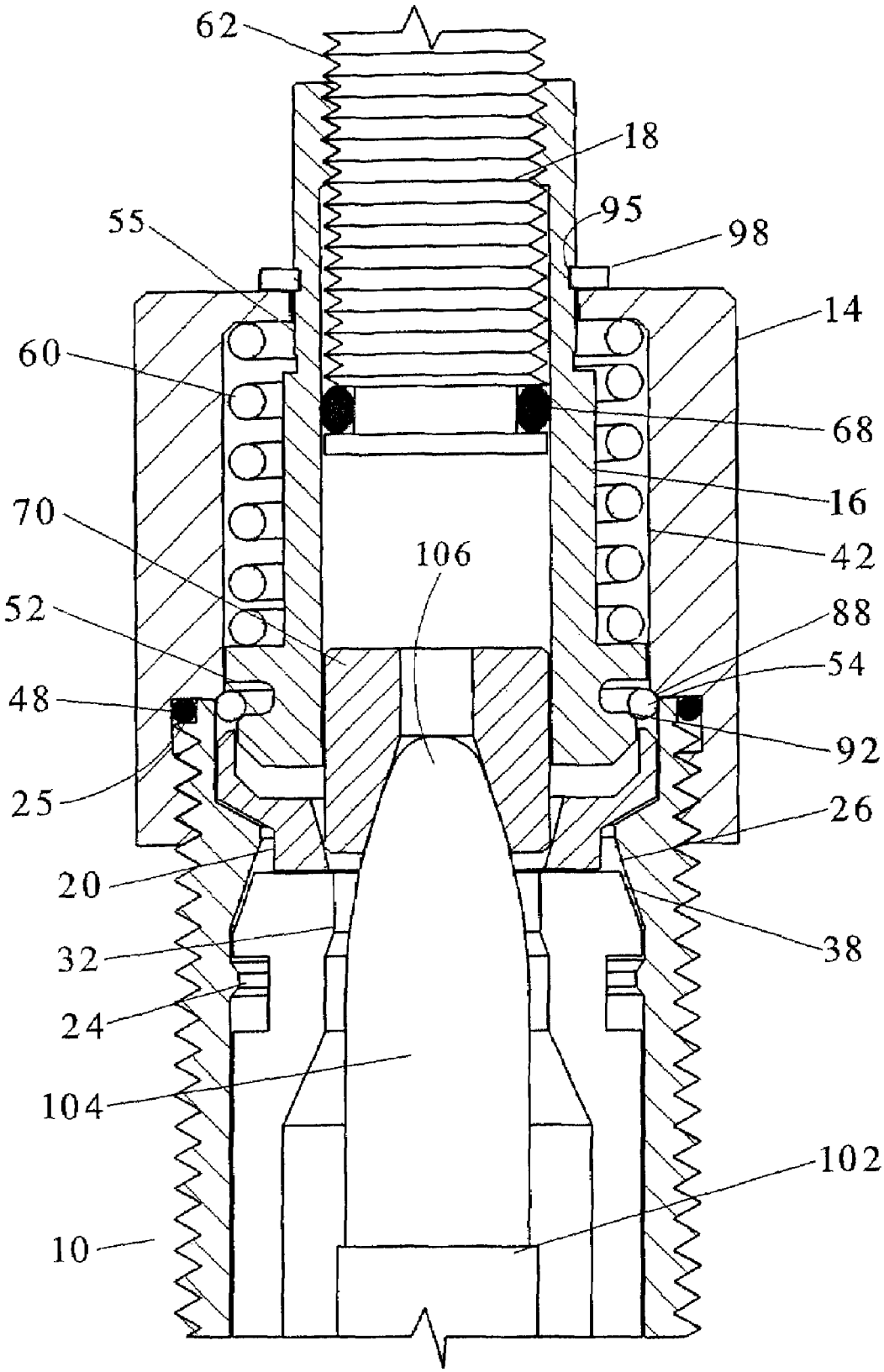
FIG. 9 is an enlarged cross sectional view of a portion of a combination crimp die with a bullet and cartridge case inserted therein in accordance with the present invention.
Figure 10:
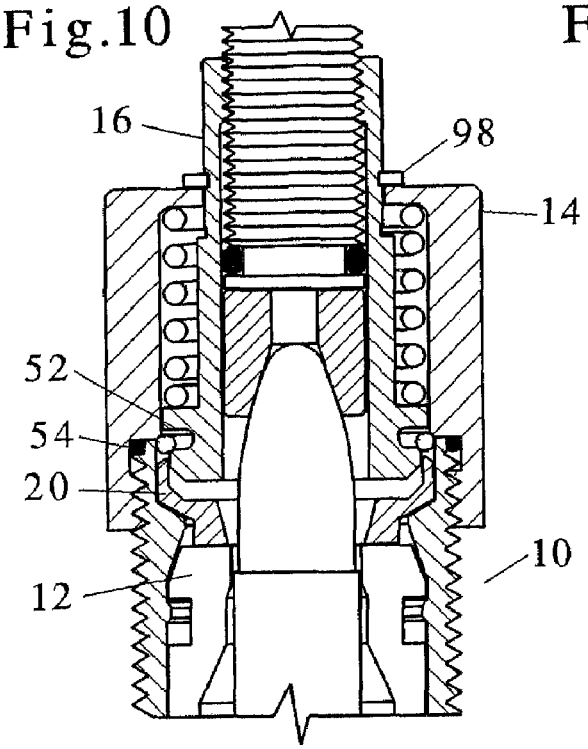
FIG. 10 is a cross sectional view of a portion of a combination crimp die with a bullet pushing a floating bullet seater against a bottom of a bullet depth adjustment screw with a C-ring sear engaged with a seating lock in accordance with the present invention.
Figure 11:
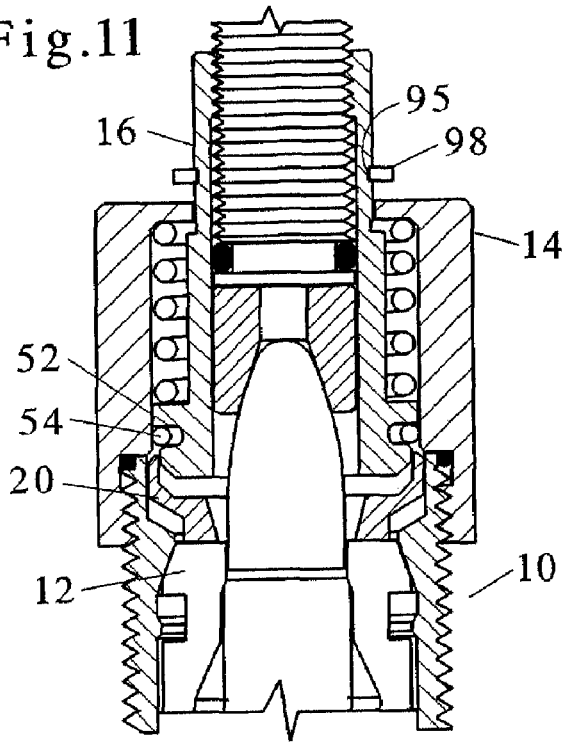
FIG. 11 is a cross sectional view of a portion of a combination crimp die after a trigger has pushed a C-ring sear into a sear groove of a die cap allowing the closing die to wedge a crimping collet to crimp a bullet in place without changing the bullet depth in accordance with the present invention.

With reference to FIGS. 5-7, the die cap 14 includes a lock counterbore 42, an inner thread 44 and a cap o-ring groove 46. The lock counterbore 42 is formed through substantially all of a length of the die cap 14, starting at one end. Preferably, an octagonal shaped opening 45 is formed through the other end of the die cap 14, but other shapes may also be used. The inner thread 44 is formed near at entrance of the lock counterbore 42. The cap o-ring groove 46 is formed in the lock counter bore 42 past the inner thread 44. The cap o-ring groove 46 is sized to receive a cap o-ring 48.

The seating lock 16 includes a spring flange 50 formed on one end. A sear groove 52 is formed in a perimeter of the spring flange to receive a C-ring sear 54. The C-ring sear 54 is biased to spread outward. A seating counterbore 56 is formed through substantially a length of the seating lock 16, starting at one end. An adjustment thread 58 is formed through the other end of the seating lock 16. The seating lock 16 is inserted into a compression spring 60 and the compression spring 60 is axially supported by the spring flange 50. The compression spring 60 is strong enough to return the seating lock 16, but not strong enough to seat a bullet 104 into the mouth 102 of the cartridge case 100. An octagonal shaped contour 55 is formed on an outer perimeter of the seating lock at substantial the other end thereof. The octagonal shaped contour 55 is sized to be received by the octagonal shaped opening 45 in the die cap 14, such that the seating lock 16 does not rotate relative to the die cap 14.

The bullet depth adjustment screw 18 includes a substantially threaded body 62, a knurled end 64 and an o-ring adjustment groove 66. The substantially threaded body 62 is threaded into the adjustment thread 58 in the seating lock 16. The knurled end 64 is formed on one end of the bullet depth adjustment screw 18 and the o-ring adjustment groove 66 is formed on the other end. The o-ring adjustment groove 66 is sized to receive an adjustment o-ring 68. The adjustment o-ring 68 resists rotation of the bullet depth adjustment screw 18 relative to the seating lock 16.

Figure 12:
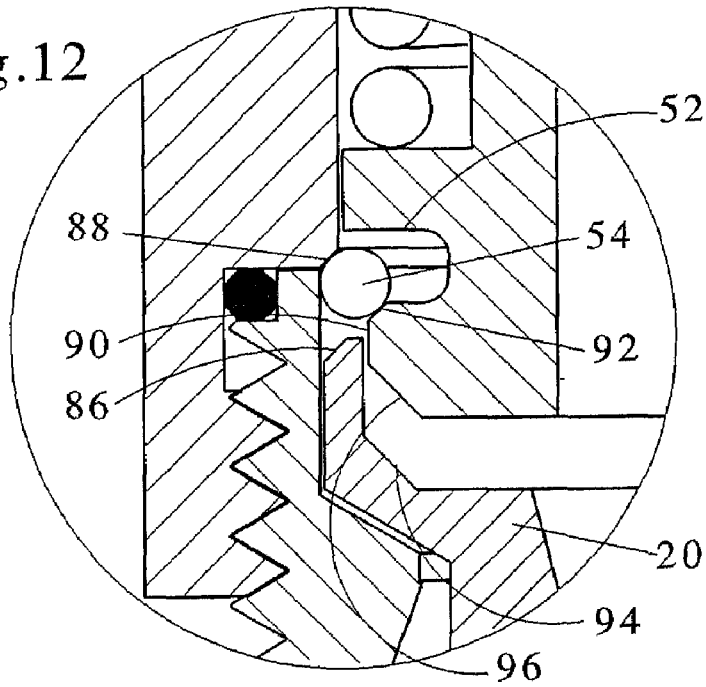
FIG. 12 is an enlarged cross sectional portion of FIG. 10 illustrating a trigger, a die cap, a seating lock and a C-ring sear of a combination crimp die in accordance with the present invention.

A floating bullet seater 70 includes a through bore 72 and a countersink 74 formed in one end thereof. An angle of the countersink 74 is sized to receive a parabolic end 106 of a bullet 104. The floating bullet seater 70 is sized to be slidably received by the seating counterbore 56. With reference to FIGS. 7 and 12, the trigger 20 includes a first outer diameter 76 and a second outer diameter 78. A peripheral chamfer 80 connects the first outer diameter 76 with the second outer diameter 78. A conical bore 82 is formed through the trigger 20 in one end and a lock counterbore 84 is formed in the other end of the trigger 20. The lock counterbore 84 is sized to receive the spring flange 50 of the seating lock 16.

A trigger chamfer 86 is formed on the other end of the trigger 20 to mate with a cap sear chamfer 88 formed on an entrance to the lock counterbore 42. A lower portion 90 of the spring flange 50 includes a reduced diameter to provide clearance for the C-ring sear 54. A lock sear chamfer 92 is formed in an edge of the sear groove 52. A strengthening chamfer 94 is formed at a bottom of the lock counterbore 84 and a trigger clearance chamfer 96 is formed on a bottom of the lower portion 90 of the spring flange 50 to provide clearance for the strengthening chamfer 94.

With reference to FIGS. 9-12, the combination crimp die 1 is preferably assembled in the following sequence. The adjustment o-ring 68 is seated in the adjustment o-ring groove 66. The bullet depth adjustment screw 18 is threaded into the adjustment thread 58 of the seating lock 16. The cap o-ring 48 is seated in the cap o-ring groove 46. The seating lock 16 is inserted through the octagonal shaped opening 45 in the die cap 14 and axially secured relative to the die cap 14 by snapping a retaining ring 98 into a ring groove 95 formed in an outer perimeter of the seating lock 16. The floating bullet seater 70 is pushed into the seating counterbore 56 of the seating lock 16.

The trigger 20 is placed in the trigger countersink 25 in the collet closing die 10. The C-ring sear 54 is squeezed and inserted into the trigger countersink 25 above the trigger 20. The collet closing die 10 is finally threaded into the die cap 14.

Figure 13:
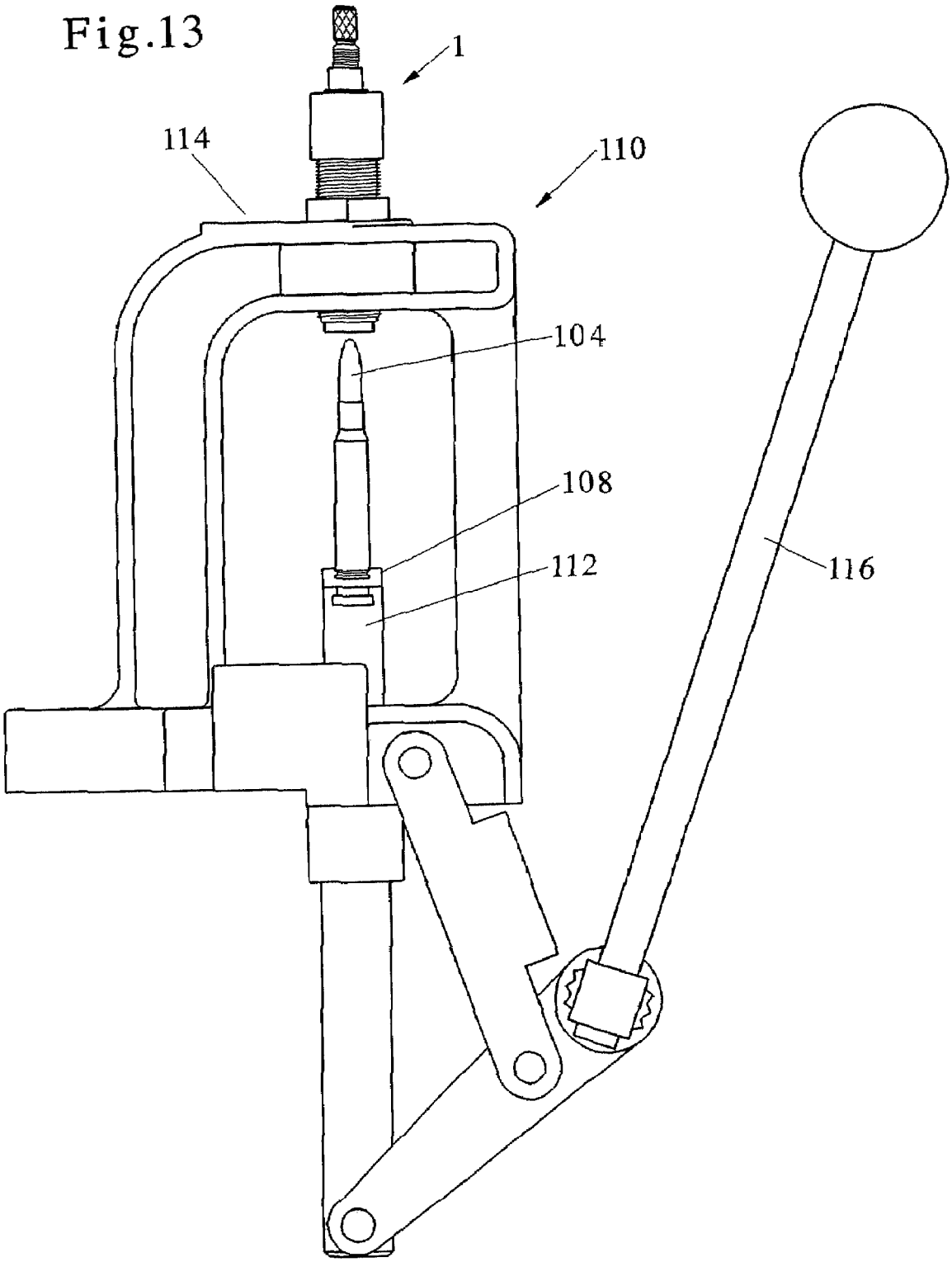
FIG. 13 is a side view of a combination crimp die installed in a reloading press with a bullet ready for seating and crimping in accordance with the present invention.

The cap o-ring 48 enables the die cap 14 to be secured to the collet closing die 10 with out exerting excessive force. The other end of the crimping collet 12 is then pushed into the one end of the collet closing die 10, until the retaining rib 24 snaps into the rib retaining groove 36. A lock nut 120 is sized to threadably receive the male thread 28 of the collet closing die 10. A lock nut o-ring groove 122 is formed in a bottom of the lock nut 120 to receive a lock nut o-ring 124. With reference to FIG. 13, the lock nut o-ring 124 allows the combination crimp die 1 to be tightened to a reloading press 110 without exerting excessive force.

In use, a bottom of the cartridge 100 is placed in a shell holder 108. The shell holder 108 is retained in a ram 112 of the reloading press 110. The combination crimp die 1 is threaded into a die holder 114 of the reloading press 110. The bullet 104 is positioned on the mouth 102 of the cartridge case 100. The bullet depth adjustment screw 18 is set to seat the bullet 104 to a particular depth. A lever arm 116 of the reloading press 110 is pulled to push the cartridge case 100 and bullet 104 into the crimping collet 12. As the bullet 104 and cartridge case 100 are pushed into crimping collet 12, the parabolic end 106 of the bullet 104 pushes one end of the floating bullet seater 70, until the other end of the floating bullet seater 70 is stopped by the other end of the bullet depth adjustment screw 18, which seats the bullet 104 in the cartridge case 100 to a desired depth.

At this point, the crimping collet 12 contacts the trigger 20 and the other end of the trigger 20 contacts the C-ring sear 54 and pushes the C-ring sear 54 into the sear groove 52, which allows the cartridge 100 and the crimping collet 12 to move in unison further into the collet closing die 10. The collet closing cone 38 of collet 12 is forced into the collet closing cone 26 of the collet closing die 10 to wedge the inner crimp bore 32 against the mouth 102 of the cartridge 100 to be crimped without the bullet 104 moving relative to the mouth 102 during crimping.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A combination bullet seating and factory crimp die, comprising:

a crimping collet including a cartridge case counterbore for receiving a cartridge case formed in one end and an inner crimp bore formed in the other end thereof;

a collet closing die having a collet bore, which is sized to receive said crimping collet;

a seating lock including a bullet seater for seating a bullet, a sear groove being formed on an outer perimeter of said seating lock to receive a sear;

a die cap including a lock counterbore for receiving said seating lock, said die cap being secured to said collet closing die; and a trigger and a sear being disposed between said crimping collet and said seating lock, wherein said trigger pushes said sear into said sear groove to prevent the bullet from being seated further, while a mouth of the cartridge case is crimped into the bullet.

2. The combination bullet seating and factory crimp die of claim 1, further comprising:

a bullet depth adjustment screw being threadably engaged with said seating lock, said bullet depth adjustment screw setting a stop position of said bullet seater.

3. The combination bullet seating and factory crimp die of claim 1, further comprising:

a spring flange being formed on an outer perimeter of said seating lock, said sear groove being formed in said spring flange.

4. The combination bullet seating and factory crimp die of claim 1, further comprising:

a compression spring being retained between said spring flange and said die cap to reset said seating lock.

5. The combination bullet seating and factory crimp die of claim 1 wherein:

a rib retaining groove being formed on an outer diameter of said crimping collet, a collet retaining rib being formed in said collet bore, axial travel of said crimping collet being limited by the movement of said retaining rib in said rib retaining groove.

6. A combination bullet seating and factory crimp die, comprising: a crimping collet including a cartridge case counterbore for receiving a cartridge case formed in one end and an inner crimp bore formed in the other end thereof; a collet closing die having a collet bore, which is sized to receive said crimping collet; a seating lock including a bullet seater for seating a bullet, a sear groove being formed on an outer perimeter of said seating lock to receive a sear, said bullet seater having axial movement within a seating counterbore of said seating lock; a die cap including a lock counterbore for receiving said seating lock, said die cap being secured to said collet closing die; and a trigger and a sear being disposed between said crimping collet and said seating lock, wherein said trigger pushes said sear into said sear groove to prevent the bullet from being seated further, while a mouth of the cartridge case is crimped into the bullet.

7. The combination bullet seating and factory crimp die of claim 6, further comprising: a bullet depth adjustment screw being threadably engaged with said seating lock, said bullet depth adjustment screw setting a stop position of said bullet seater.

8. The combination bullet seating and factory crimp die of claim 6, further comprising:

a spring flange being formed on an outer perimeter of said seating lock, said sear groove being formed in said spring flange.

9. The combination bullet seating and factory crimp die of claim 6, further comprising:

a compression spring being retained between said spring flange and said die cap to reset said seating lock.

10. The combination bullet seating and factory crimp die of claim 6 wherein:

a rib retaining groove being formed on an outer diameter of said crimping collet, a collet retaining rib being formed in said collet bore, axial travel of said crimping collet being limited by the movement of said retaining rib in said rib retaining groove.

11. A combination bullet seating and factory crimp die, comprising: a crimping collet including a cartridge case counterbore for receiving a cartridge case formed in one end and an inner crimp bore formed in the other end thereof; a collet closing die having a collet bore, which is sized to receive said crimping collet; a seating lock including a bullet seater for seating a bullet, a sear groove being formed on an outer perimeter of said seating lock to receive a sear; a die cap including a lock counterbore for receiving said seating lock, said die cap being secured to said collet closing die; and a trigger and a sear being disposed between said crimping collet and said seating lock, wherein said trigger pushes said sear into said sear groove to prevent the bullet from being seated further, while a mouth of the cartridge case is crimped into the bullet; and said combination bullet seating and factory crimp die being retained in a reloading press.

12. The combination bullet seating and factory crimp die of claim 11, further comprising: a bullet depth adjustment screw being threadably engaged with said seating lock, said bullet depth adjustment screw setting a stop position of said bullet seater.

13. The combination bullet seating and factory crimp die of claim 11, further comprising:

a spring flange being formed on an outer perimeter of said seating lock, said sear groove being formed in said spring flange.

14. The combination bullet seating and factory crimp die of claim 11, further comprising:

a compression spring being retained between said spring flange and said die cap to reset said seating lock.

15. The combination bullet seating and factory crimp die of claim 11 wherein:

a rib retaining groove being formed on an outer diameter of said crimping collet, a collet retaining rib being formed in said collet bore, axial travel of said crimping collet being limited by the movement of said retaining rib in said rib retaining groove.

* * * * *